US006217285B1

(12) United States Patent
Kurokawa et al.

(10) Patent No.: US 6,217,285 B1
(45) Date of Patent: Apr. 17, 2001

(54) IMPELLER FOR A CENTRIFUGAL BLOWER

(75) Inventors: Michihiro Kurokawa; Noriyuki Nabeshima; Kenji Ueyama, all of Hirakata; Katuyoshi Oki, Kashihara; Kenji Nasako, Hirakata, all of (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 08/906,910

(22) Filed: Aug. 6, 1997

(30) Foreign Application Priority Data

Aug. 8, 1996 (JP) ..... 8-227772
Aug. 8, 1996 (JP) ..... 8-227773
Aug. 9, 1996 (JP) ..... 8-227546

(51) Int. Cl.[7] ..... F04D 29/30

(52) U.S. Cl. ..... 416/186 R; 416/188; 416/223 B; 416/242; 416/DIG. 5

(58) Field of Search ..... 416/182, 185, 416/186 R, 188, 223 B, 242, DIG. 5

(56) References Cited

U.S. PATENT DOCUMENTS 4,231,706 * 11/1980 Ueda et al. ..... 416/186 R
4,274,810 * 6/1981 Nishikawa ..... 416/186 R
4,432,694 * 2/1984 Kuroda et al. ..... 416/186 R
4,526,506 * 7/1985 Koger et al. ..... 416/185
4,647,271 * 3/1987 Nagai et al. ..... 416/186 R
5,478,201 * 12/1995 Amr ..... 416/186 R
5,741,118 * 4/1998 Shinbara et al. ..... 416/186 R

FOREIGN PATENT DOCUMENTS 55-66696 * 5/1980 (JP) ..... 416/182
55-125396 * 9/1980 (JP) ..... 416/186 R

* cited by examiner

*Primary Examiner*—Christopher Verdier
(74) *Attorney, Agent, or Firm*—Armstrong, Westerman, Hattori, McLeland & Naughton

(57) ABSTRACT

An impeller for use in a centrifugal blower comprises a hub for receiving a driving torque at a central portion thereof, a shroud of a ring-like shape in plane formed with an opening for air intake at the center thereof and opposed to the hub across a required distance therebetween, and a plurality of vane members interposed between the hub and shroud as circumferentially spaced from one another at required intervals, the impeller having an arrangement wherein an leading edge of each vane member has varied angles (inlet angles) with respect to a tangent line thereat thereby conforming to inflow angles of an air flow guided by the vane member at different points of a span between the shroud and hub.

10 Claims, 11 Drawing Sheets

IMPELLER FOR A CENTRIFUGAL BLOWER

BACKGROUND OF THE INVENTION

1. Field of the Invention

The present invention relates to an impeller for use in a centrifugal blower employed by air conditioning equipment and the like, the impeller comprising a hub for receiving a driving torque at a central portion thereof, a shroud of a ring-like shape in plane formed with an opening for air intake at the center thereof and opposed to the hub across a required distance therebetween, and a plurality of vane members interposed between the hub and shroud as circumferentially spaced from one another at required intervals, and more particularly to an impeller adapted to take in air from the air intake 12*a* of the shroud and to efficiently discharge the air from the impeller.

1. Description of the Related Art

Conventionally, the air conditioners have employed various types of blowers for feeding air to the heat exchangers and the like. A centrifugal blower has been widely used as one of such blowers.

The centrifugal blowers have generally employed an impeller 10 comprising a hub 11 of a circular shape in plan having a protrusion at the center thereof, a shroud 12 of a ring-like shape in plane formed with an opening for air intake 12*a* and opposed to the hub 11 across a required distance therebetween, and a plurality of vane members 13 interposed between the hub 11 and shroud 12 as circumferentially spaced from one another at required intervals, as shown in FIGS. 1 and 2.

The centrifugal blower is arranged such that a torque is applied to the central portion of the hub 11 for rotating the impeller 10 which, in turn, is allowed to produce an air flow entering the impeller 10 from the air intake 12*a* of the shroud 12 to be guided by the rotating vane members 13 through gaps between the hub 11 and shroud 12 and out of the outer periphery of the impeller 10.

Various types of vane members 13 have heretofore been developed in many attempts to increase the efficiency of discharging the air from the aforementioned impeller 10 which is adapted to rotate for producing the air flow running thereinto from the air intake 12*a* to be guided by the rotating vane members 13 through the gaps between the hub 11 and shroud 12 and out of the outer periphery of the impeller 10.

In the conventional impeller as shown in FIG. 3, the vane members 13 are interposed between the hub 11 and the shroud 12 in a manner such that leading edges of the vane members 13 each form an angle θ (inlet angle) with a tangent line to an inner circumference defined by the vane members 13, the angle 0 conforming to an inflow angle ϕ of the air flow introduced into the gap between adjacent vane members 13. Each vane member 13 has the inlet angle θ at any points of a span between the hub 11 and shroud 12.

Unfortunately, if the impeller 10 with the vane members 13 of such an arrangement is caused to rotate to produce the air flow running into the impeller 10 and through the gaps between the hub 11 and shroud 12 to be discharged from the outer periphery of the impeller 10, the air flow guided by the vane members 13 fails to run in line with the surfaces thereof, thus departing therefrom and hence, the occurrence of eddies results. The eddies interferes with the flow of air to be discharged as guided by the vane members 13 and hence, the efficiency of air discharge is decreased and increased noises are produced during operation.

Furthermore, the conventional impeller 10 is arranged such that the air is drawn through the air intake 12*a* and guided through the gaps between the hub 11 and shroud 12 to be discharged horizontally from the outer periphery of the impeller 10. Accordingly, the vane members 13 each have an trailing edge portion substantially extended horizontally, as seen in FIGS. 4 and 5.

Unfortunately, in the arrangement adapted for the air flow running into the impeller 10 from the air intake 12*a* to be discharged horizontally from the outer periphery thereof as guided by the vane members, air streams closer to the shroud 12 with the air intake 12*a* are reduced in a flow rate as discharged whereas air streams closer to the hub 11 are correspondingly increased in the flow rate as discharged. A difference of the flow rate between the air streams near the shroud 12 and those near the hub 11 results in the occurrence of eddy which, in turn, causes turbulence of the air flow. The turbulent air flow not only leads to an increased noise during operation but also interferes with the flow of air to be discharged as guided by the vane members 13. As a result, the air feeding efficiency is decreased.

SUMMARY OF THE INVENTION

It is therefore, an object of the invention to provide the impeller for use in the centrifugal blower, which is caused to rotate for producing an air flow running thereinto from the air intake at the center of the shroud and guided by the vane members through the gaps between the hub and shroud and out of the outer periphery of the impeller, the impeller contributing to the reduction of occurrence of eddy or the like produced from the air flow departed from the vane members and to a smooth air flow running in line with the vane members for an efficient discharge of the air from the outer periphery of the impeller.

It is another object of the invention to reduce noises while the impeller is caused to rotate in the aforesaid manner for discharging the air from the outer periphery thereof.

According to a first aspect of the invention, the impeller for use in the centrifugal blower comprises a hub for receiving a driving torque at a central portion thereof, a shroud of a ring-like shape in plane formed with an opening for air intake and opposed to the hub across a required distance therebetween, and a plurality of vane members interposed between the hub and shroud as spaced from one another at required intervals, the impeller having an arrangement wherein an leading edge of each vane member forms varied angles (inlet angles) with a tangent line thereat such as to conform to inflow angles of an air flow at different points of a span between the shroud and hub.

According to the impeller of the first aspect of the invention wherein the leading edge of each vane member has varied angles such as to conform to the inflow angles of the air streams at different points of the span between the shroud and hub, the vane members can cause the air streams to run in line with the surfaces thereof at any points of the span between the hub and shroud, while the impeller is rotated to produce the air streams drawn thereinto and guided by the vane members through the gaps between the hub and shroud and out of the outer periphery of the impeller. Such air streams are effective to reduce the occurrence of eddy or the like, thus allowing the vane members to more efficiently discharge the air from the outer periphery of the impeller. Additionally, the production of noises is also decreased.

According to a second aspect of the invention, the impeller for use in the centrifugal blower comprises a hub for receiving the driving torque at a central portion thereof, a shroud of a ring-like shape in plane formed with an opening for air intake at the center thereof and opposed to the hub across a required distance therebetween, and a plurality of vane members interposed between the hub and shroud as circumferentially spaced from one another at required intervals, the impeller having a arrangement wherein a trailing edge of each vane member forms varied angles (outlet angles) with the tangent line thereat such as to conform to outflow angles of the air discharged by the vane members at different points of the span between the shroud and hub.

According to the impeller of the second aspect of the invention wherein the trailing edge of each vane member forms varied outlet angles such as to conform to the outflow angles of the discharged air at different points of the span between the shroud and hub, the vane members can cause the air streams to run in line with the surfaces thereof at any points of the span between the shroud and hub thereby efficiently discharging the air from the outer periphery of the impeller, while the impeller is rotated to produce such air streams. Additionally, the reduction of noises is also accomplished.

According to a third aspect of the invention, the impeller for use in the centrifugal blower comprises a hub for receiving the driving torque at a central portion thereof, a shroud of a ring-like shape in plane formed with an opening for air intake and opposed to the hub across a required distance therebetween, and a plurality of vane members interposed between the hub and shroud as circumferentially spaced from one another at required intervals, the impeller having an arrangement wherein the ratio (d/D) of a diameter d of the air intake at the center of the shroud to a diameter D of the impeller is in the range of between 0.67 and 0.78.

According to the impeller of the third aspect of the invention wherein the ratio (d/D) of the diameter d of the air intake at the center of the shroud to the diameter D of the impeller is in the range of between 0.67 and 0.78, the rotating impeller is allowed to produce stable and even air streams entering the impeller from the air intake and flowing through the gaps between the hub and shroud to be discharged from the outer periphery of the impeller as guided by the vane members. Such stable air streams reduce the production of noises due to turbulence of the air flow. If the ratio (d/D) of the diameter d of the air intake to the diameter D of the impeller is defined at around 0.73, in particular, more stable air streams may be obtained for further enhancing the effect of reducing the noises.

According to a fourth aspect of the invention, the impeller for use in the centrifugal blower comprises a hub for receiving the driving torque at a central portion thereof, a shroud of a ring-like shape in plane formed with an opening for air intake at the center thereof and opposed to the hub across a required distance therebetween, and a plurality of vane members interposed between the hub and the shroud as circumferentially spaced from one another at required intervals, the impeller having an arrangement wherein each vane member extends diagonally relative to the horizontal line, thus having an trailing edge portion thereof forming an angle of between 30° and 50° with the horizontal line.

According to the impeller of the fourth aspect of the invention wherein each vane member extends diagonally relative to the horizontal line thus having the trailing edge portion thereof forming the angle of between 30° and 50° with the horizontal line, the air flow does not suffer an increased difference of flow rates between the shroud side and the hub side while the impeller is rotated to produce the air flow running thereinto from the air intake and discharged from the outer periphery thereof as guided by the vane members. Thus, the turbulence is prevented from occurring in the air flow discharged from the outer periphery of the impeller and therefore, the vane members are allowed to efficiently discharge the air from the outer periphery of the impeller with reduced noises.

These and other objects, advantages and features of the invention will become apparent from the following description thereof taken in conjunction with the accompanying drawings which will illustrate specific embodiments of the invention.

DESCRIPTION OF THE PREFERRED EMBODIMENTS

Now, preferred embodiments of the impeller for the centrifugal blower according to the invention will be described in detail with reference to the accompanying drawings.

(Embodiment 1)

Figure 1:
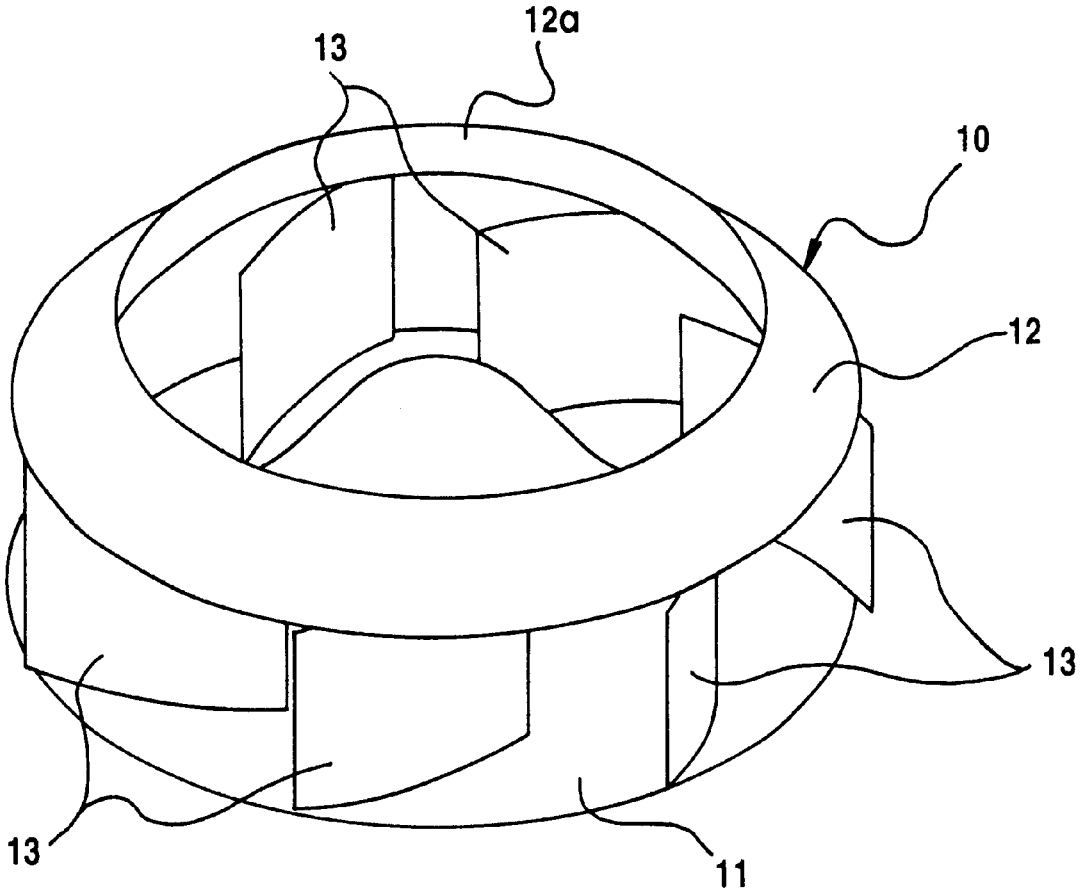
Fig.1 PRIOR ART
FIG. 1 is a perspective view showing an impeller used for a centrifugal blower.
Figure 2:
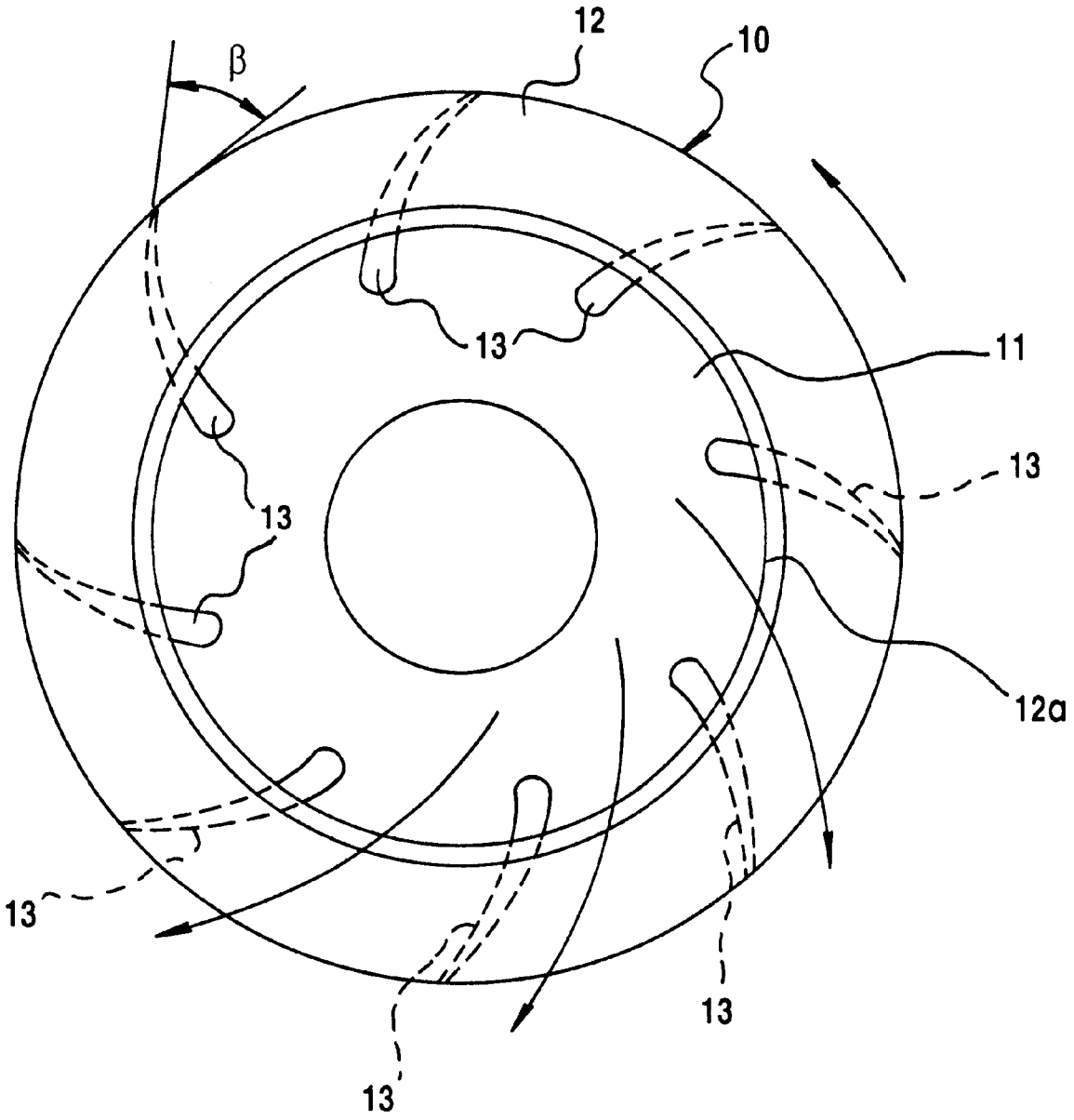
Fig.2 PRIOR ART
FIG. 2 is a top plan view showing the impeller used for the centrifugal blower.
Figure 3:
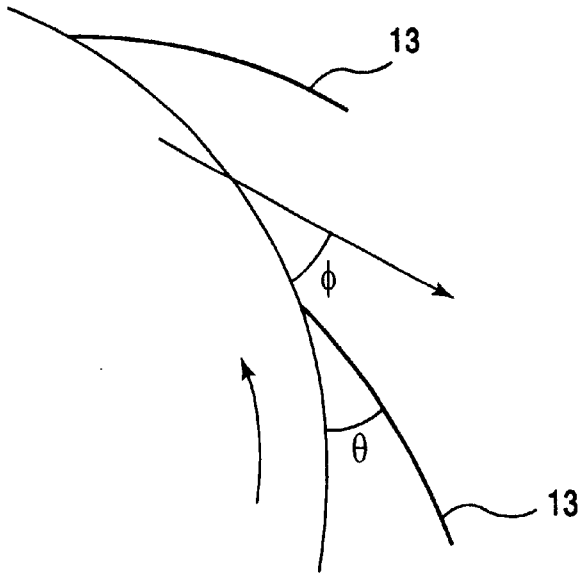
Fig.3 PRIOR ART
FIG. 3 is a schematic diagram showing the impeller for the centrifugal blower wherein an leading edge of a vane member forms an inlet angle conforming to an inflow angle of the air flow.
Figure 4:
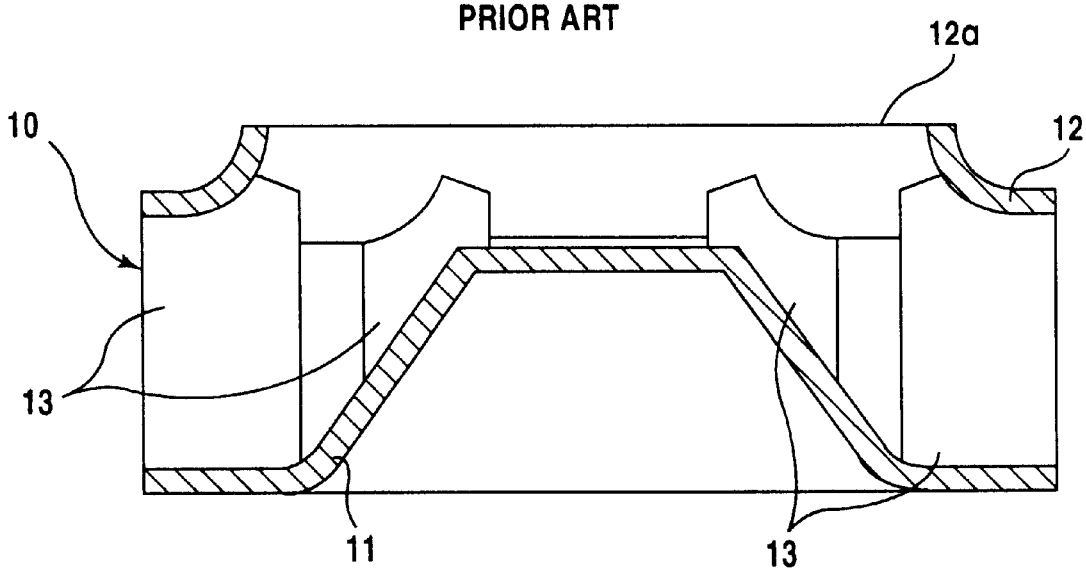
Fig.4 PRIOR ART
FIG. 4 is a schematic sectional view showing a conventional impeller for use in the centrifugal blower.
Figure 5:
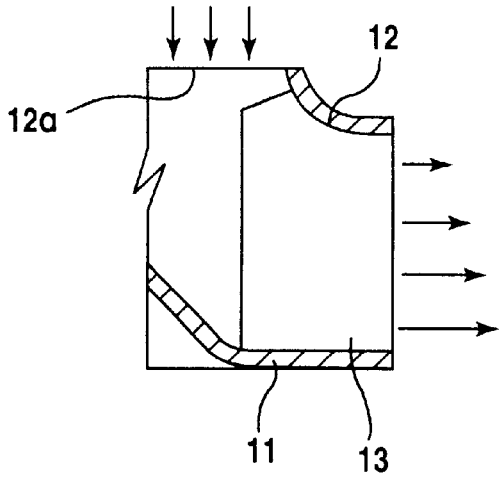
Fig.5 PRIOR ART
FIG. 5 is a schematic diagram showing how the air streams are discharged from the outer periphery of the rotating impeller of FIG. 4.

Similarly to the conventional impeller shown in FIGS. 1 and 2, an impeller 10 for the centrifugal blower according to this embodiment comprises a hub 11 of a circular shape in plane adapted to receive a driving torque at a central portion thereof and having a protrusion at the center thereof, a shroud 12 of a ring-like shape in plane formed with an opening for an air intake 12*a* at the center thereof and opposed to the hub 11 across a required distance therebetween, and a plurality of vane members 13 interposed between the hub 11 and the shroud 12 as circumferentially spaced from one another at required intervals.

The impeller 10 of the embodiment has an arrangement wherein the vane members 13 are interposed between the hub 11 and the shroud 12 in a manner such that an leading edge of each vane member forms varied angles (inlet angles 0) with a tangent line thereat thereby conforming to inflow angles $\phi$ of air streams at different points of a span between the shroud 12 and the hub 11.

Figure 6:
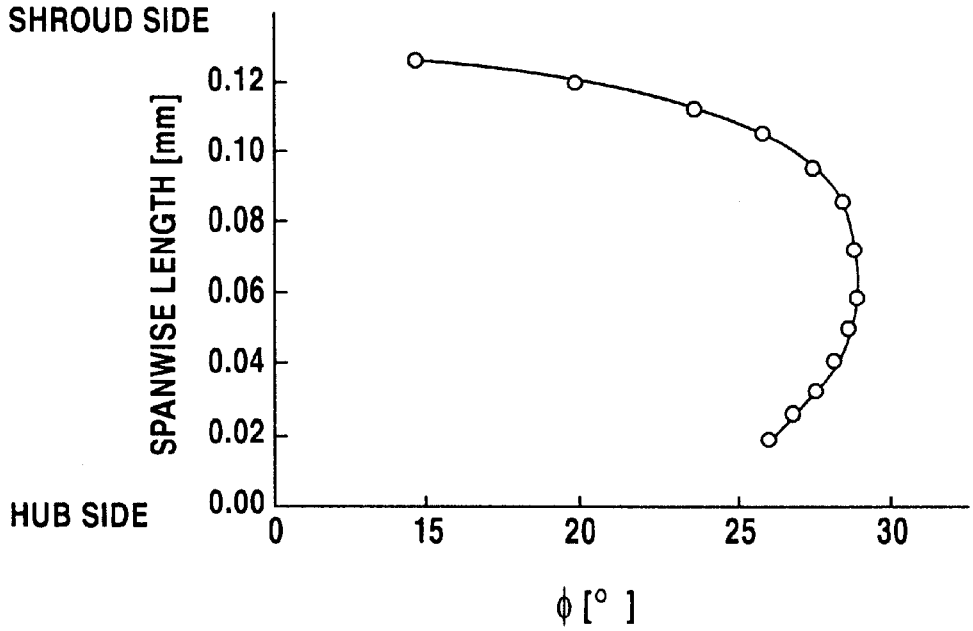
FIG. 6 is a graphical representation showing how the inflow angle of the air flow varies at the leading edge of the vane member at different points of a span between a shroud and a hub of the impeller for the centrifugal blower in accordance with a first embodiment hereof.

This impeller 10 was rotated to produce air streams running thereinto from the air intake 12*a* at the center of the shroud 12 and guided into gaps between adjacent vane members 13, while inflow angles $\phi$ of the air streams at different points of the leading edge of the vane member interposed between the hub 11 and shroud 12 were measured. The results are shown in FIG. 6.

According to the results, the air streams from the air intake 12*a* into the gaps between the vane members 13 present smaller inflow angles $\phi$ at points closer to the shroud 12 with the air intake 12*a*. The inflow angle $\phi$ gradually increases as the point shifts to the middle point of the span between the shroud 12 and hub 11 but somewhat decreases as the point shifts beyond the middle point toward the hub 11.

Figure 7A:
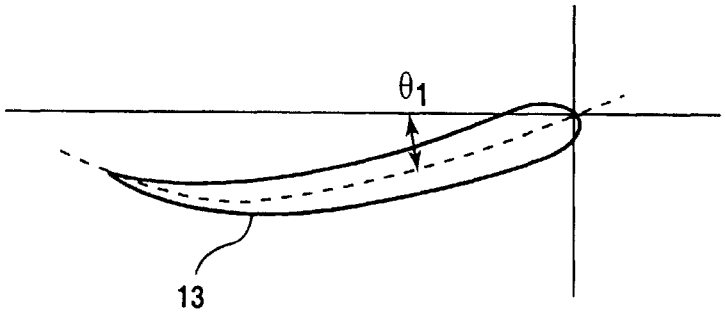
FIGS. 7A to 7C schematically illustrate how the leading edge of the vane member has varied inlet angles such as to conform to inflow angles of the air flow at different points of the span between the shroud and hub of the impeller for the centrifugal blower in accordance with the first embodiment of the invention.
Figure 7B:
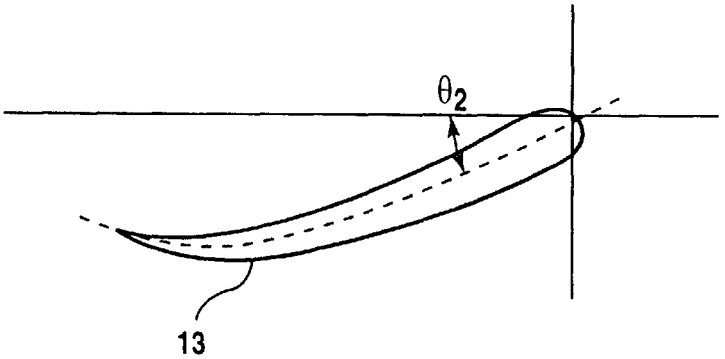
Figure 7C:
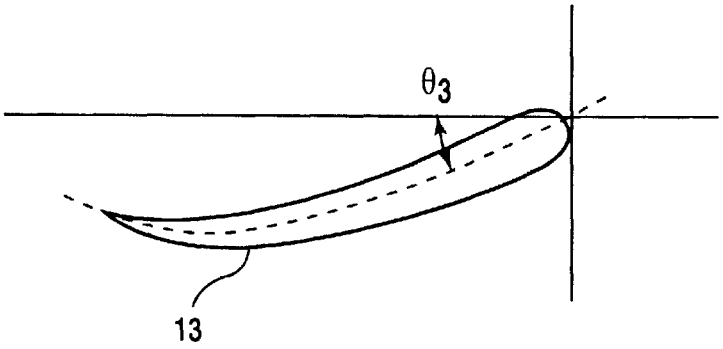

In this embodiment, the vane members 13 interposed between the shroud 12 and hub 11 are each configured to have varied inlet angles $\theta$ at different points of the span between the shroud 12 and hub 11 thereby conforming to the inflow angles $\phi$ of the air streams. As shown in FIG. 7A, each of the vane members 13 has the smallest inlet angle $\theta 1$ at the point closest to the shroud 12, the inlet angle $\theta 1$ gradually increased as the point shifts toward the middle point of the span between the shroud 12 and hub 11. The vane member 13 has the greatest inlet angle $\theta 2$ at the middle point of the span, as shown in FIG. 7B, which angle $\theta 2$ is gradually decreased as the point shifts from the middle point toward the hub 11. As shown in FIG. 7C, each of the vane members 13 has an inlet angle $\theta 3$ at the point closest to the hub 11 which is smaller than the inlet angle $\theta 2$ at the middle point but greater than the inlet angle $\theta 1$ at the closest point to the shroud 12.

Figure 8:
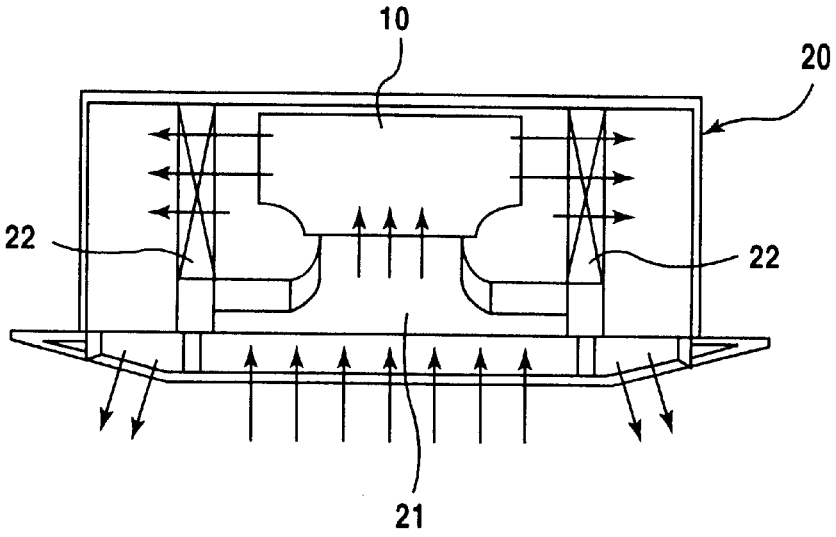
FIG. 8 schematically illustrates a state wherein the impeller for the centrifugal blower of the first embodiment hereof is housed in a heat exchanger unit and operated.

The impeller 10 of the embodiment was housed in a heat exchanger unit 20, as shown in FIG. 8. A torque was applied to the central portion of the hub 11 for rotating the impeller 10 thereby producing the air streams running through a bell mouth 21 and the air intake 12*a* and into the impeller 10. The rotating vane members 13 served to guide the air streams through the gaps between the hub 11 and shroud 12 and out of the outer periphery of the impeller 10. The air flow thus discharged was drawn into a heat exchanger 22 housed in the heat exchanger unit 20 to be subject to the heat exchanging process. Subsequently, the resultant air was discharged from the heat exchanger unit 20.

In the above arrangement wherein the rotating impeller 10 is adapted to produce the air streams entering the impeller 10 to be guided through the gaps between the shroud 12 and hub 11 and out of the outer periphery of the impeller, each of the vane members 13 is configured to have such inlet angles $\theta$ as to conform to the inflow angles $\phi$ of the air streams at different points of the span between the shroud 12 and hub 11. Therefore, the rotating vane members cause the air streams to run in line with the surfaces thereof at any points of the span between the hub and shroud thereby improving the efficiency of discharging the air from the outer periphery of the impeller 10. Additionally, the reduction of noises due to turbulence of the air flow is also accomplished.

Figure 9:
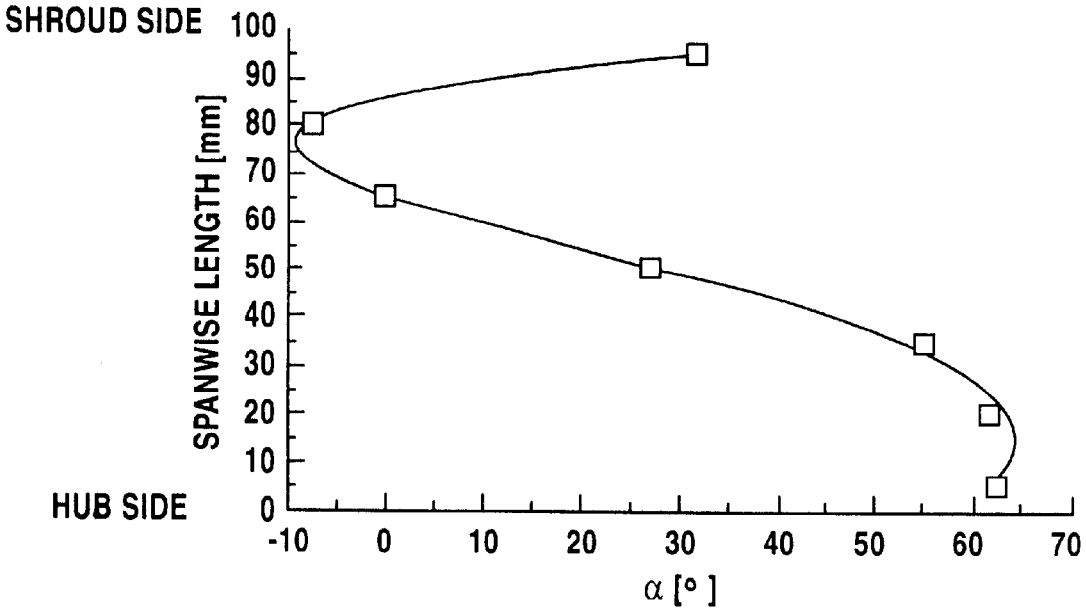
FIG. 9 is a graphical representation showing how the outflow angle of the air discharged by the vane members varies at different point of the span between the shroud and hub of the impeller for the centrifugal blower in accordance with the first embodiment hereof.

The impeller 10 of the embodiment was rotated in the aforementioned manner to produce the air flow entering the impeller 10 from the air intake 12*a* at the center of the shroud 12 and guided by the vane members 13 through the gaps between the hub 11 and shroud 12 and out of the outer periphery of the impeller 13, while outflow angles $\alpha$ of the air streams thus discharged were measured at different points of the span between the shroud 12 and hub 11. The results are shown in FIG. 9.

According to the results, the discharged air flow presents relatively a large outflow angle a at a point close to the shroud 12, which angle $\alpha$ sharply decreases to the minimum angle $\alpha$ as the point shifts away from the shroud 12. Subsequently, the outflow angle a of the air flow gradually increases as the point shifts toward the hub 11, standing substantially at a constant value at points near the hub 11.

Figure 10:
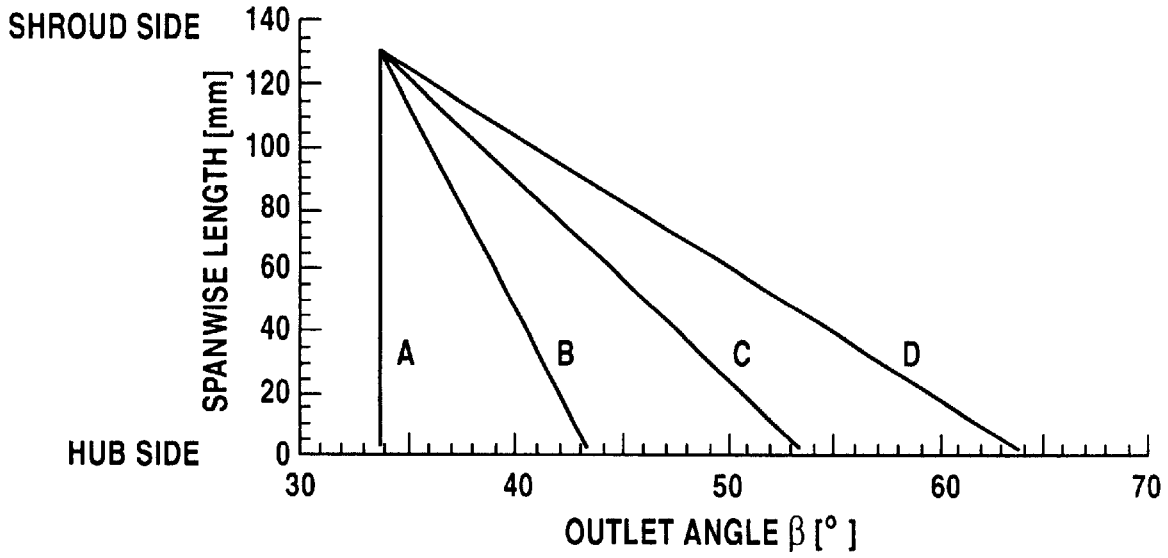
FIG. 10 is a graphical representation showing examples of the vane member of the impeller for the centrifugal blower according to the first embodiment hereof, wherein the trailing edge of the vane member for discharging the air has the outlet angle varied over the span between the shroud and the hub.
Figure 11:
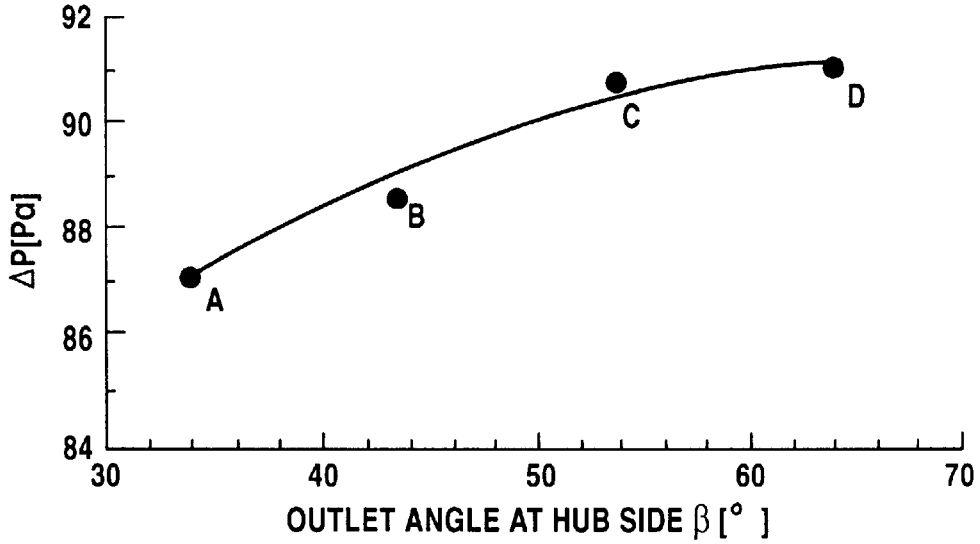
FIG. 11 is a graphical representation showing how the pressure difference $\Delta P$(Pa) between a pressure of air entering gaps between adjacent vane members and that of the air discharged therefrom differs among the vane members of FIG. 10, the trailing edges of which have outlet angles varied over the span between the shroud and hub, respectively.

As shown in FIG. 10, an angle β (outlet angle) formed between a line extended from the trailing edge of the vane member 13 and a tangent line thereat to the outer circumference defined by the vane members was varied over spans A to D between the shroud 12 and hub 11, respectively. As to the respective cases of A to D, a pressure difference ΔP(Pa) between a pressure of the air guided into the gaps between the vane members 13 and that of the air discharged therefrom was measured. The results are shown in FIG. 11.

According to the results, great pressure differences ΔP are obtained in the cases of C and D wherein the variation of the outlet angles β of the vane members 13 somehow conforms to the variation of the outflow angles a of the air flow discharged therefrom. Thus are provided air streams flowing in line with the surfaces of the vane members 13 over the spans between the shroud 12 and hub 11 to be efficiently discharged from the outer periphery of the impeller 10. In addition, the reduction of noises due to turbulence of the air streams is also accomplished.

(Embodiment 2)

Similarly to the conventional impeller shown in FIGS. 1 and 2, an impeller 10 for use in the centrifugal blower according to this embodiment hereof comprises a hub 11 of a circular shape in plane adapted to receive the. driving torque at a central portion thereof and formed with a protrusion at the center thereof, a shroud 12 of a ring-like shape in plane formed with an opening for air intake 12*a* and opposed to the hub 11 across a required distance therebetween, and a plurality of vane members 13 interposed between the outer peripheral portions of the hub 11 and shroud 12 as circumferentially spaced from one another at required intervals.

Figure 12:
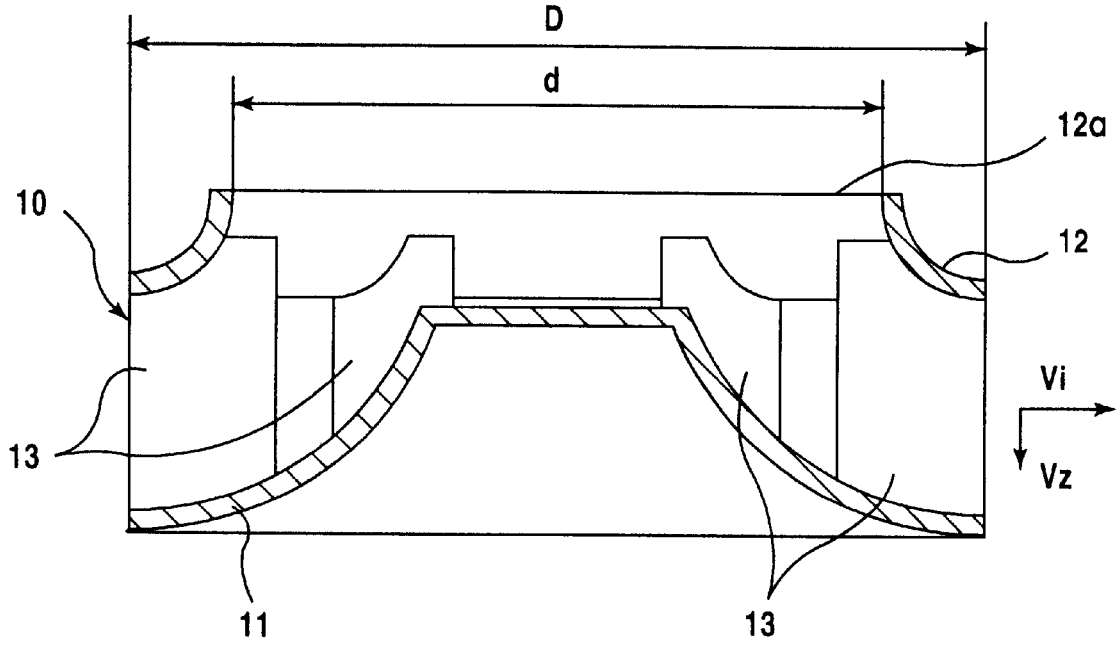
FIG. 12 is a schematic sectional view showing an impeller for the centrifugal blower according to a second embodiment hereof wherein the ratio (d/D) of the diameter d of an air intake at the center of the shroud to the diameter D of the impeller is in the range of between 0.67 and 0.78.

In this embodiment as shown in FIG. 12, an adjustment was made to a ratio (d/D) of a diameter d of the air intake 12*a* at the center of the shroud 12 to a diameter D of the impeller 10 such that the ratio value (d/D) was in the range of between 0.67 and 0.78.

Then, a similar arrangement to that of the first embodiment was made such that the impeller 10 of this embodiment was housed in a heat exchanger unit 20 and was rotated by means of the hub 11 for producing the air flow through a bell mouth 21 and the air intake 12*a* and into the impeller 10. The rotating vane members 13 guided the air streams running though the gaps between the hub 11 and shroud 12 and out of the outer periphery of the impeller 10. The air streams thus discharged were drawn into a heat exchanger 22 housed in the heat exchanger unit 20 so as to be subject to the heat exchange process. Subsequently, the resultant air was discharged from the heat exchanger unit 20.

Figure 13:
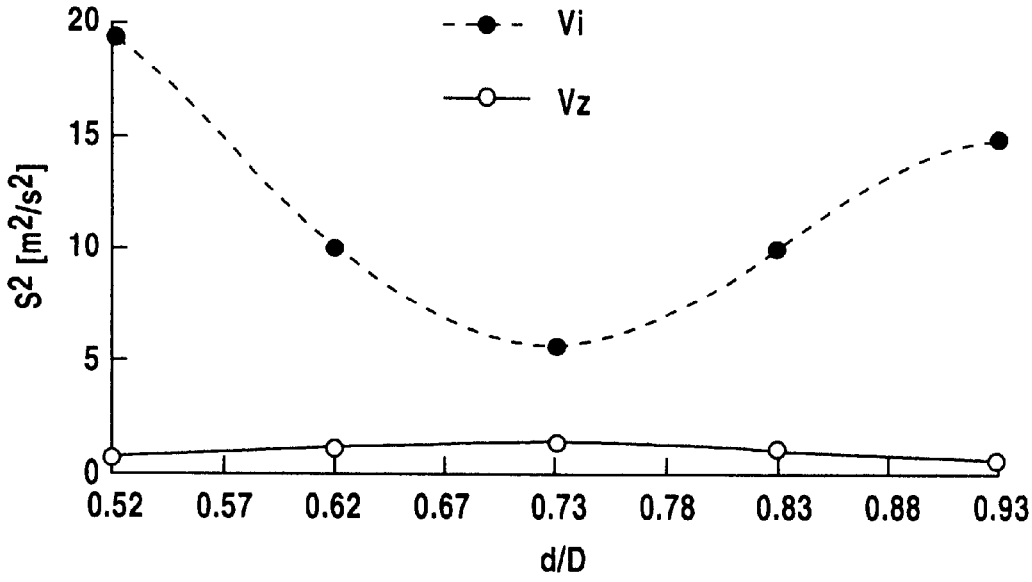
FIG. 13 is a graphical representation showing how the scatters $S^2(m^2/s^2)$ of the radial velocity Vi(m/s) and the axial velocity Vz(m/s) of the air flow discharged from the outer periphery of a rotating impeller differs among the impellers for the centrifugal blower of the second embodiment hereof, each of which impellers has a different ratio (d/D) of the diameter d of the air intake at the center of the shroud to the diameter D of the impeller.

Next, the impellers of the embodiment was varied in the ratio (d/D) of the diameter d of the air intake 12*a* in the center of the shroud 12 to the diameter D of the impeller 10. The impellers 10 having different (d/D) values were each rotated while a radial velocity Vi(m/s) and an axial velocity Vz(m/s) of the air flow discharged from the outer periphery thereof were measured to obtain scatters $S^2(m^2/s^2)$ of the respective velocities. The results are shown in FIG. 13.

According to the results, the axial velocity Vz of the discharged air flow presents small scatter values $S^2$ and small variations thereof in correspondence with the varied (d/D) values. On the other hand, the radial velocity Vi of the discharged air flow presents great scatter values $S^2$ and great variations thereof in correspondence with the varied (d/D) values. The radial velocity Vi presents decreased scatter values $S^2$ in correspondence to the (d/D) values of between 0.67 and 0.78. The radial velocity Vi presents a notably decreased scatter value $S^2$ in correspondence to the (d/D) value of about 0.73, in particular.

Hence, if the (d/D) value is defined in the range of between 0.67 and 0.78, or more preferably at around 0.73, the air flow through the gaps between the hub 11 and shroud 12 and out of the outer periphery of the impeller 10 suffers decreased air turbulence. Thus is provided an efficient discharge of the air from the outer periphery of the impeller 10. Furthermore, the reduction of noises due to turbulence of the air flow is accomplished.

(Embodiment 3)

Similarly to the conventional impeller shown in FIGS. 1 and 2, an impeller 10 for the centrifugal blower according to this embodiment hereof comprises a hub of a circular shape in plane adapted to receive the driving torque at a central portion thereof and formed with a protrusion at the center thereof, a shroud 12 of a ring-like shape in plane formed with an opening for air intake 12*a* at the center thereof and opposed to the hub 11 across a required distance therebetween, and a plurality of vane members 13 interposed between the outer peripheral portions of the hub 11 and shroud 12 as circumferentially spaced from one another at required intervals.

Figure 14:
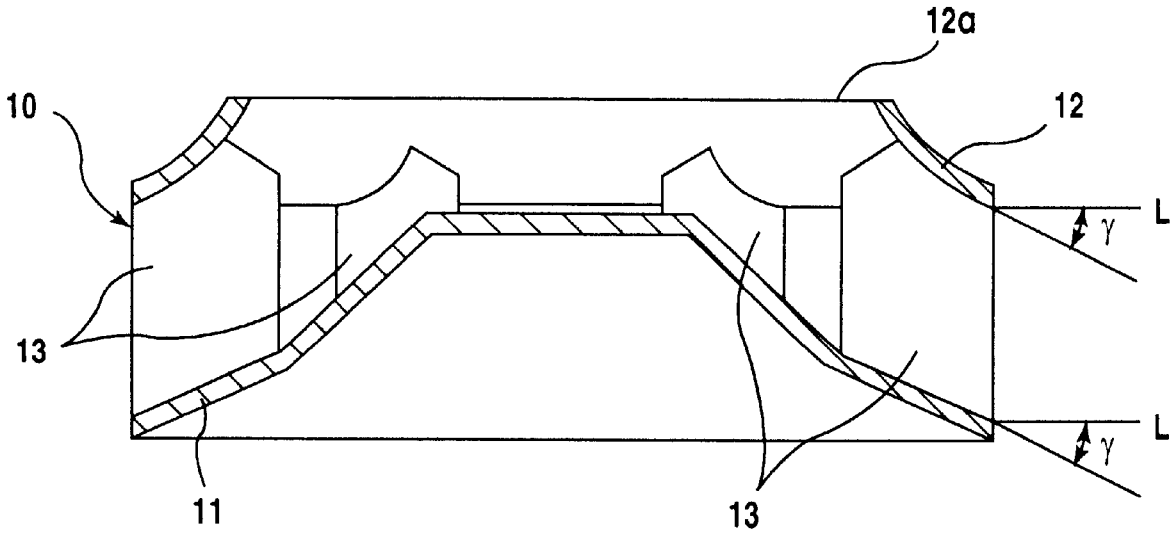
FIG. 14 is a schematic sectional view showing an impeller for the centrifugal blower according to a third embodiment hereof wherein a plurality of vane members are extended diagonally relative to the horizontal line L and interposed between the hub and shroud as spaced circumferentially from one another at required intervals.
Figure 15:
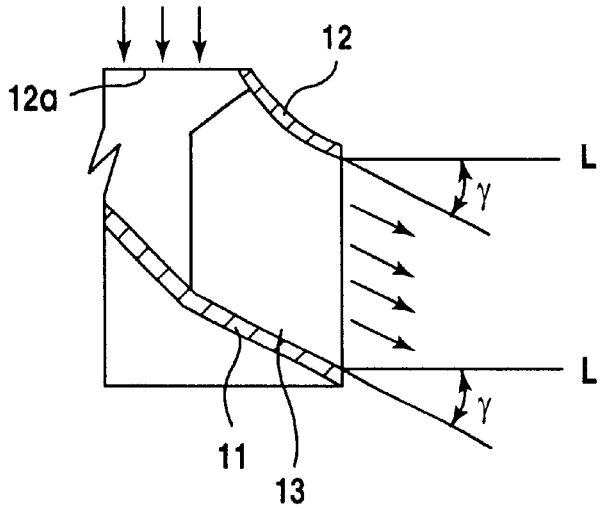
FIG. 15 schematically illustrates how the air flow is discharged from the outer periphery of the rotating. impeller of FIG. 14.

In the impeller 10 of this embodiment, as shown in FIGS. 14 and 15, the hub 11 and shroud 12 have their respective outer peripheral portions inclined downward to receive the vane members 13 therebetween, each vane member extending diagonally downward relative to the horizontal line L whereby an trailing edge portion of the vane member 13 forms an angle γ of between 30° and 50° with the horizontal line L.

Figure 16:
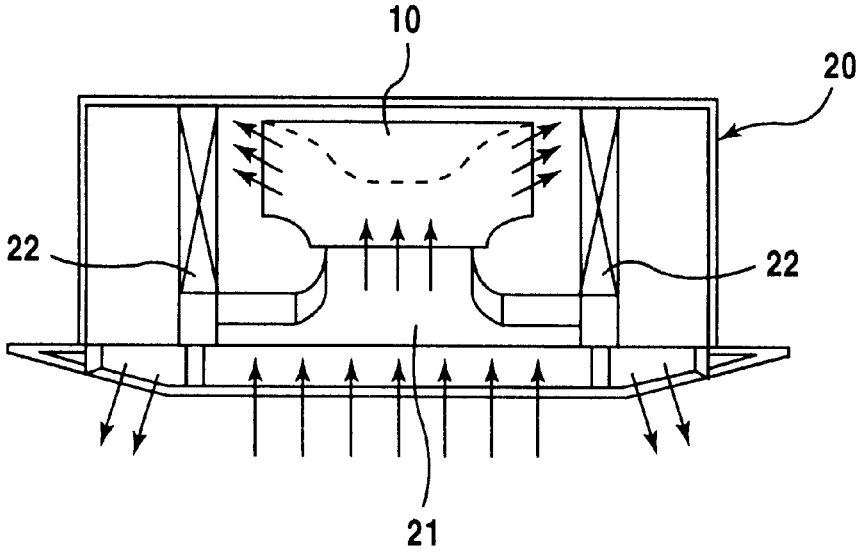
FIG. 16 schematically illustrates a state wherein the impeller for the centrifugal blower of the third embodiment hereof is housed in a heat exchanger unit and operated.

The impeller 10 of this embodiment was housed in a heat exchanger unit 20, as shown in FIG. 16, so that the impeller 10 was rotated by way of the hub 11 for producing the air flow through a bell mouth 21 and the air intake 12*a* and into the impeller 10. The rotating vane members 13 caused the air streams to flow through the gaps between the hub 11 and shroud 12 and out of the outer periphery of the impeller 10. The air streams thus discharged were drawn into a heat exchanger 22 housed in the heat exchanger unit 20 so as to be subject to the heat exchanging process. Subsequently, the resultant air was discharged from the heat exchanging unit 20.

Figure 17:
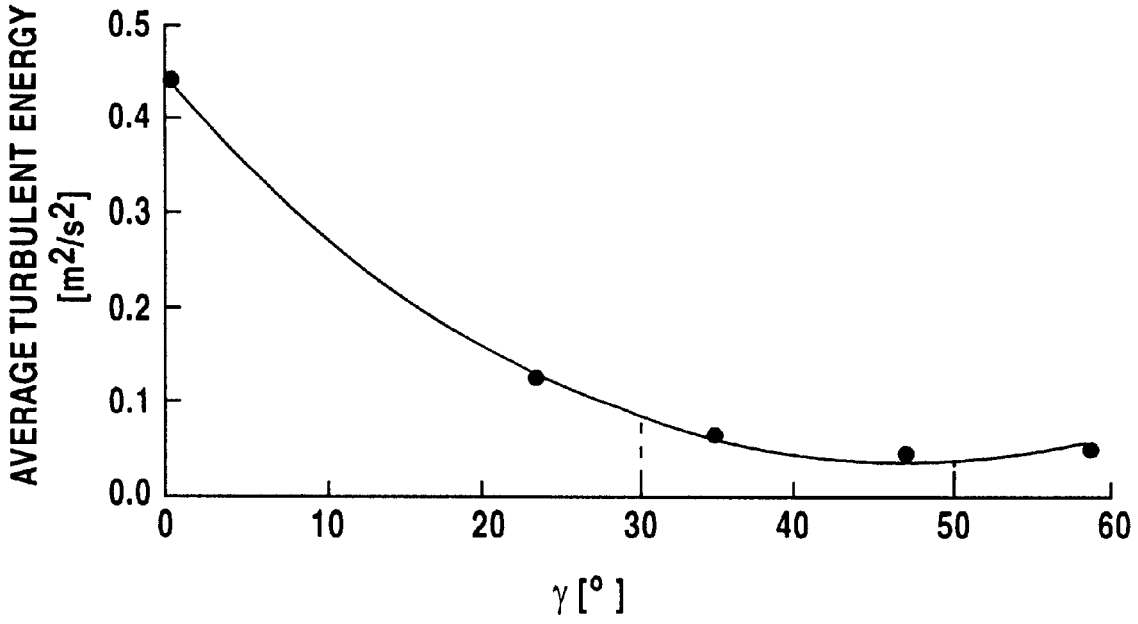
FIG. 17 is a graphical representation showing how the average turbulent energy ($m^2/s^2$) of the air discharged from the outer periphery of the rotating impeller differs among impellers for the centrifugal blower of the third embodiment hereof, which impellers have different angles $\gamma$ relative to the horizontal line L at the trailing edge portions of the vane members thereof, respectively.
Figure 18:
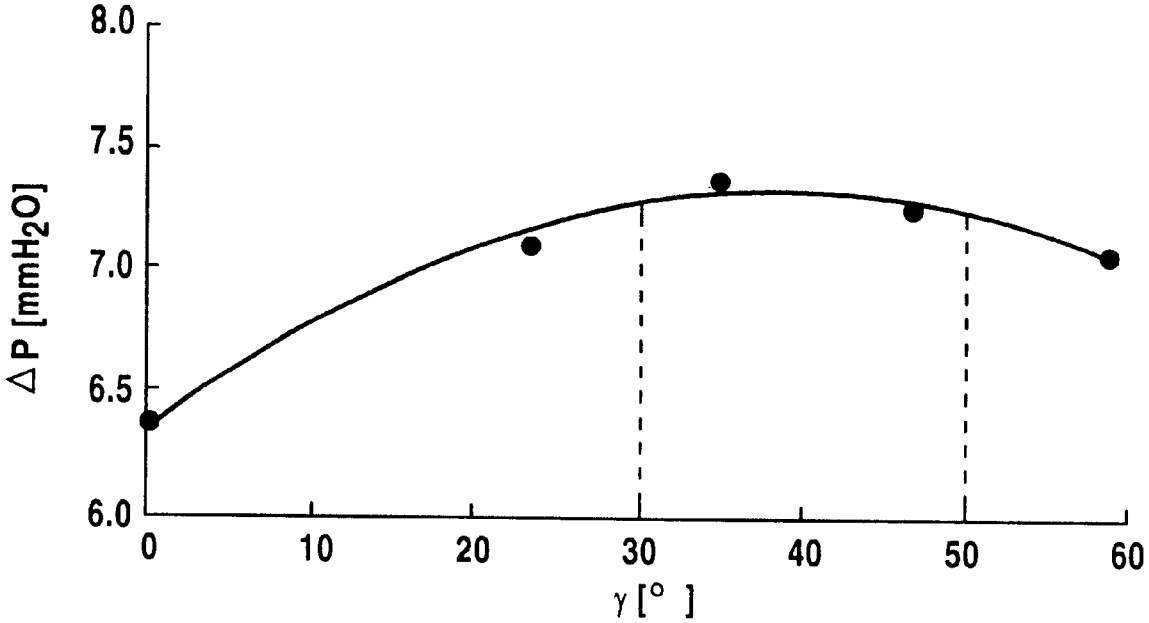
FIG. 18 is a graphical representation showing how the pressure difference $\Delta P$ ($mmH_2O$) between a pressure of the air at the air intake and that of the air discharged from the outer periphery of the rotating impeller differs among impellers for the centrifugal blower according to the third embodiment hereof, which impellers have different angles $\gamma$ relative to the horizontal line L at the trailing edge portions of the vane members thereof, respectively.

Next, there were prepared impellers 10 each of which had a different angle γ from those of the other impellers, the angle γ formed between a line extended from the trailing edge of the vane member and the horizontal line L. Each of the impellers 10 was rotated to produce the air streams through the gaps between the hub 11 and shroud 12 and out of the outer periphery of the impeller 10 while the average turbulent energy $(m^2/S^2)$ of the air streams was measured. The results are shown in FIG. 17. Additionally, the pressure difference ΔP ($mmH_2O$) between an air pressure at the air intake 12*a* and a pressure of the air discharged from the outer periphery of the impeller 10 was also measured. The results are shown in FIG. 18.

According to the results, with increase in the angle γ formed between the trailing edge of the vane member 13 and the horizontal line L, the air flow discharged from the outer periphery of the impeller 10 presents a correspondingly decreased average turbulent energy and hence, the air flow discharged from the outer periphery of the impeller 10 suffers less air turbulence. In addition, the increase in pressure difference ΔP between the air pressure at the air intake 12*a* and that of the air flow discharged from the outer periphery of the impeller 10 is accomplished. In case where the angle γ formed between the trailing edge of the vane member 13 and the horizontal line L is in the range of between 30° and 50°, in particular, the turbulence of the air flow discharged from the outer periphery of the impeller 10 is notably decreased and the reduction of noises during operation is accomplished. In addition, an increased pressure difference between the air pressure at the air intake 12*a* and the pressure of air discharged from the outer periphery of the impeller is provided thereby achieving a higher efficiency of air feeding. Incidentally, if the angle γ formed between the trailing edge of the vane member 13 and the horizontal line L exceeds 50°, the length of the air flow through the gaps between the vane members 13 is increased to produce resistance to the air flow, which resistance correspondingly reduces the pressure difference between the air pressure at the air intake 12*a* and that of the air discharged from the outer periphery of the impeller. Hence, it becomes no more possible to provide the efficient air feeding.

Although the present invention has been fully described by way of examples, it is to be noted that various changes and modifications will be apparent to those skilled in the art.

Therefore, unless otherwise such changes and modifications depart from the scope of the invention, they should be construed as being included therein.

What is claimed is:

1. An impeller for use in a centrifugal blower comprising a hub for receiving driving torque at a central portion thereof, a shroud of a ring-like shape in plan formed with an opening for air intake at the center thereof and opposed to said hub across a distance therebetween, and a plurality of vane members interposed between said hub and shroud as circumferentially spaced from one another at intervals, the impeller having an arrangement wherein an edge on the inner side of each vane member, into which air is guided, has varied angles with respect to a tangent line thereat thereby conforming to inflow angles of an air flow guided into the vane member at different points of a span between the hub and shroud, and wherein the edge on the inner side of each vane member has a straight-line portion extending between the hub and the shroud and parallel to an impeller axis.

2. An impeller for the centrifugal blower as set forth in claim 1, wherein said inlet angles of the vane member are at least decreased at a portion closer to the shroud from the intermediate portion between the hub and shroud.

3. An impeller for the centrifugal blower as set forth in claim 1, wherein said inlet angles of the vane member are decreased at portions closer to the shroud and to the hub from the intermediate portion between the shroud and hub.

4. An impeller for the centrifugal blower as set forth in claim 1, wherein the angles formed between said edge on the inner side of each vane member and the tangent lines thereat are varied in a direction of the axis of the impeller so as to conform to the inflow angles of the air flow guided into the vane member.

5. An impeller for the centrifugal blower as set forth in claim 1, wherein a heat exchanger is provided on the periphery of the centrifugal blower.

6. An impeller for the centrifugal blower as set forth in claim 1, wherein a ratio (d/D) of a diameter d of the air intake at the center of the shroud to a diameter D of the impeller is in the range of between 0.67 and 0.78.

7. An impeller for use in a centrifugal blower comprising a hub for receiving a driving torque at a central portion thereof, a shroud of a ring-like shape in plan formed with an opening for air intake at the center thereof and opposed to said hub across a distance therebetween, and a plurality of vane members interposed between said hub and shroud as circumferentially spaced from one another at intervals, the impeller having an arrangement wherein an edge on the outer side of each vane member, from which air is discharged, has varied angles with respect to a tangent line thereat thereby conforming to outflow angles of an air flow guided into the vane member at different points of a span between the shroud and hub, and wherein an edge on the inner side of each vane member has a straight-line portion extending between the hub and the shroud and parallel to an impeller axis.

8. An impeller for the centrifugal blower as set forth in claim 7, wherein said outlet angles of the vane member are greater on the hub side than on the shroud side.

9. An impeller for the centrifugal blower as set forth in claim 7, wherein the edge on the inner side of each vane member, into which air is guided, has varied angles with respect to a tangent line thereat thereby conforming to inflow angles of an air flow guided by the vane member at different points of a span between the shroud and hub.

10. An impeller for the centrifugal blower as set forth in claim 7, wherein a heat exchanger is provided on the periphery of the centrifugal blower.

* * * * *